US005964368A

United States Patent [19]

Schramm

[11] Patent Number: 5,964,368

[45] Date of Patent: Oct. 12, 1999

[54] ELASTIC LOOP CLOSURE HOLDER

[76] Inventor: Michael A. Schramm, 8511 Forest La., Juneau, Ak. 99801

[21] Appl. No.: 08/906,426

[22] Filed: Aug. 5, 1997

[51] Int. Cl.[6] ..... B65D 45/32

[52] U.S. Cl. ..... 220/320; 206/805; 220/315; 220/319; 220/359.2; 220/359.3; 292/256.65; 292/299

[58] Field of Search ..... 220/256, 315, 220/319, 287, 615, 622, 684, 780, 616, 326, 683, 359.1, 359.2, 359.3, 321, 634, 495.08, 495.11; 206/805; 215/319; 292/38, 246, 299, 256.65; 383/68, 81

[56] References Cited

U.S. PATENT DOCUMENTS

| | | | |
|---|---|---|---|
| 1,797,539 | 3/1931 | Arthur | 220/805 X |
| 2,004,449 | 6/1935 | Stanley . | |
| 2,064,411 | 12/1936 | Brandstein . | |
| 2,080,108 | 5/1937 | Brandstein . | |
| 2,146,190 | 2/1939 | Luke . | |
| 2,388,738 | 11/1945 | Gudheim . | |
| 2,903,034 | 9/1959 | Vrana . | |
| 3,495,759 | 2/1970 | Bergstrom et al. . | |
| 4,305,535 | 12/1981 | Brundige et al. | 220/780 X |
| 4,347,948 | 9/1982 | Hamada et al. | 220/495.11 |
| 5,048,714 | 9/1991 | Stevens . | |
| 5,435,648 | 7/1995 | Berkoff | 383/68 X |
| 5,476,187 | 12/1995 | Marisco | 220/908 X |
| 5,690,248 | 11/1997 | Hulls | 220/495.05 |

FOREIGN PATENT DOCUMENTS

| | | | |
|---|---|---|---|
| 686273 | 5/1964 | Canada | 220/683 |
| 866639 | 5/1941 | France . | |
| 1182612 | 1/1959 | France . | |
| 3615680 | 11/1987 | Germany . | |
| 4021211 | 2/1991 | Germany | 220/319 |
| 571759 | 1/1958 | Italy | 220/321 |
| 335602 | 2/1959 | Switzerland | 383/81 |
| 18664 | of 1912 | United Kingdom . | |
| 973460 | 10/1964 | United Kingdom . | |

*Primary Examiner*—Allan N. Shoap
*Assistant Examiner*—Joe Merek
*Attorney, Agent, or Firm*—Clyde I. Coughenour

[57] ABSTRACT

Essentially "U" shaped endless elastic loops, with the opening facing inwardly, removably hold first foil covers over access openings of flanged containers. The foil is placed over the container opening and flange formed around the opening. The elastic loop is stretched to encompass the foil cover and flange and then released to secure the foil cover over the access opening. Clamping strips can be provided with the elastic loops to hold second foil covers onto the elastic loops and over the container openings. The clamping strips are provided with protrusions or recesses that match recesses or protrusions on the upper surfaces of the elastic loop to clamp foils between them and over the access openings.

20 Claims, 1 Drawing Sheet

ELASTIC LOOP CLOSURE HOLDER

BACKGROUND OF THE INVENTION

1. Field of the Invention

A closure for an outwardly flanged open top container is disclosed. A "U" shaped endless elastic loop having its recess facing inwardly is stretched over the flange of the container to hold a foil or wrap in place over the open top of the container.

2. Description of the Related Art

The use of removable closures has been common for centuries. This use includes resilient loop means holding foil covers over access openings, such as a paper or plastic held by an elastic band. The U.S. Pat. No 2,064,411; issued to S. J. Brandstein, issued Dec. 15, 1936 and U.S. Pat. No. 2,080,108; issued May 11, 1937; the U.S. Pat. No. 2,146,190; to J. W. Luke, issued Feb. 7, 1939 and German DE 3,615,680 A1 of Nov. 12, 1987 to W. Kunzel are examples of resiliently held covers on containers. The patent to G. S. Stanley, U.S. Pat. No. 2,004,449, issued Jun. 11, 1935, British Patent No. 973,460 of Oct. 28, 1964 to J. K .M. Cooke, and British Patent A.D. 1911, No. 18,664 of Jul. 11, 1912 to H. H. Denman et al are examples of flanged containers provided with closure means including resilient inwardly facing "U" shaped securing means. The French patent, 1,182,612, issued to Illinois Tool Works, Delivered Jan. 19, 1959, teaches an indented retainer used over the bead of a shaped cover.

SUMMARY OF THE INVENTION

The present invention provides a closure for a container having an access opening with a flange extending outwardly around the opening. An endless elastic loop, having an essentially "U" shape, has its recess or opening facing inwardly. The elastic loop can hold a foil over the opening. This is done by pressing the foil against the end or edges of the flange and stretching and slipping the elastic loop over the foil and flanges and then releasing the elastic loop. The legs of the loop can be provided with beads on their inner surfaces to also press the foil against the top and bottom of the flange. The upper leg of the elastic loop can be provided with a recess or protrusion to interact with a mating clamping strip protrusion or recess. A foil can be placed and clamped between the protrusion and recess. The mating protrusion and recess can alternately cooperate to clamp a second foil between them while a first foil is clamped over the container opening by the elastic loop.

DESCRIPTION OF THE PREFERRED EMBODIMENT

Figure 1:
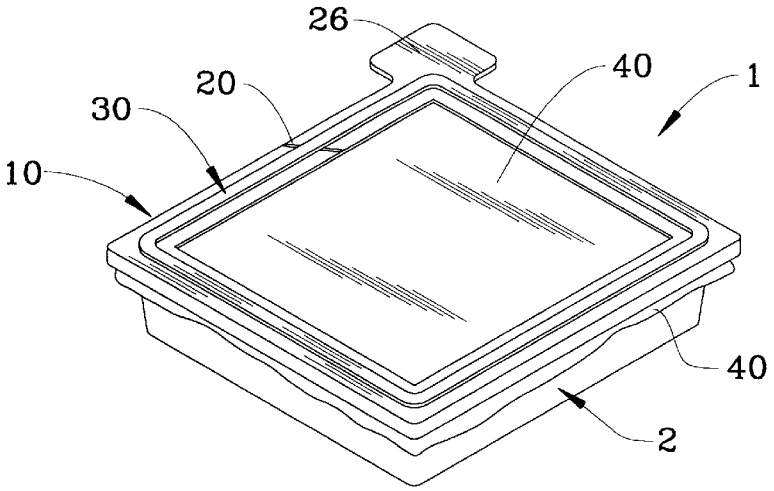
FIG. 1 is a perspective view showing a container with a foil cover secured in place by the device of the invention.

The preferred embodiment, as shown in FIG. 1, has in combination 1 a pan or container 2 having a closure or foil 40 held in place over the container access opening by an elastic loop 10. The elastic loop is endless and has indentations 20 pressed into an upper portion to form a hinge means for bending back a portion of the elastic loop to provide partial access into the container. A tab 26 extends from one corner of the elastic loop for pulling on or manipulating the elastic loop. A clamping strip 30 is shown attached to the top of the elastic loop.

The pan 2 is a rigid or semi-rigid pan with the preferred material being stainless steel. The closure foils can be any resilient material such as paper or aluminum but a transparent plastic foil or wrap is preferred. The material used is chosen for the environment and temperature(s) it is to be used in. The preferred material is one that is air tight and moisture proof and that is capable of functioning under freezer and/or oven conditions. The elastic loop 10 can be molded or pressed from a rubber or other elastic material. The main concern is that the elastic loop be capable of stretching a minimum of 2% of its length so that it can be stretched and placed over the flange and then be capable of returning to its original length and shape when released. The elastic loop should be capable of functioning in a freezer and/or oven.

Figure 2:
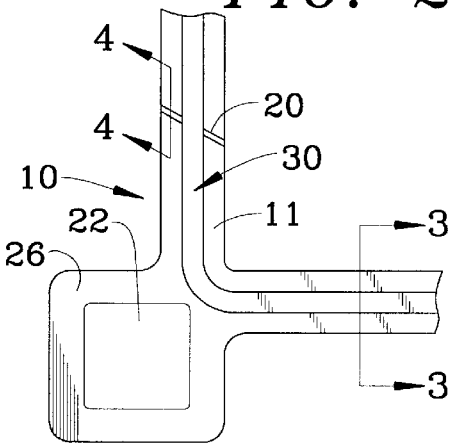
FIG. 2 is a fragmentary top view of the device of the invention.

FIG. 2 is an enlarged portion of the elastic loop 10 of FIG. 1 showing the tab, hinge area. A hinge forming indentation 20 is shown extending across the upper portion of the elastic loop 10 with a tab 26 shown at one corner of the elastic loop. As shown in FIGS. 1 and 2, the tab extends outwardly in a limited area from the base 12 in a plane that is essentially the same as that of the elastic loop legs 11, 13. One or more tabs 26 can be provided as a gripping means for stretching the elastic loop to remove it from or to apply it over and onto the pan flange 3. A flat indicia area 22 on the tab provides an area for placing a label on or an area for writing information on, such as for identifying the contents of the pan and the date the contents were placed in the pan. The elastic loop and/or the tab can be color coded as a means of quickly identifying a type of material or food placed in the pan. For example a red gasket could identify a meat, yellow a poultry, blue a cooked food, green a fish, etc., to prevent cross-contamination and for easy identification. As an alternative, the elastic loop and/or tab can be color coded as a means of quickly identifying the type of material it is made of and thus the temperature that it can be used at.

Figure 3:
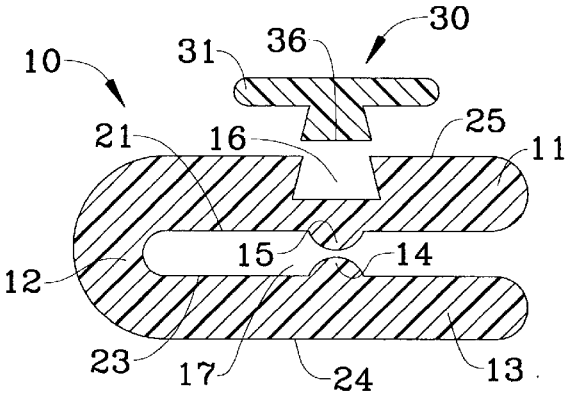
FIG. 3 is a detailed vertical sectional view taken along the lines 3—3 of FIG. 2 with the parts shown separated.

FIG. 3 is a cross-section of the elastic loop 10 as shown by the section lines 3—3 in FIG. 2. It shows a pan flange receiving recess 17 facing inwardly. The recess is formed between the lower elastic loop leg 13 inner surface 23 and the upper elastic loop leg 11 inner surface 21. The lower elastic loop leg 13 and the upper elastic loop leg 11 extend inwardly from the elastic loop base 12. The recess 17 has a depth essentially equal to that of the width of the upper and lower loop legs 11, 13 and a height less than that of the thickness of the upper and lower loop legs 11, 13 and about that of the container flange 3 thickness. The recess is essentially in a common plane formed by the elastic loop upper and lower legs. The lower leg 13 is provided somewhere along its length with one or more beads, with one bead 14 shown, and the upper leg 11 is provided with one or more beads, with one bead 15 shown. The beads face each other and extend parallel to the base 12 for providing a clamping pressure on foils along the entire length of the flange the foils are placed over.

By molding or forming the legs 11, 13 of the elastic loop with a minimum clearance between the legs 11, 13 and the beads 14, 15, the spreading caused by placement of the pan flange 3 between the legs results in an inward force exerted on the beads 14, 15 that presses any foil placed over the pan flange onto the flange upper and lower surfaces. The legs can be molded so that they taper and touch each other at their ends for an added inward force when placed over a pan flange.

While the elastic loop 10 can be used alone, it is shown in use with a clamping strip 30. Either one of the clamping strip 30 or the elastic loop 10 can be provided with one or more recesses while the other is provided with one or more protrusions. The upper elastic loop leg 11 is shown having a recess or mortise 16. A clamping strip 30 is shown having extensions 31, used for pressing the strip onto the elastic loop and for removing it from the elastic loop. The clamping strip is also shown with a protrusion or tenon 36. The protrusion or tenon 36 is sized and shaped to cooperate with the recess or mortise 16 in the elastic loop upper leg 11. The recess and protrusion are shown in the shape of a dovetail. The shape is somewhat irrelevant and any convenient cross-sectional shape can be used such as an oval, circle, square, etc. The material and rigidity of the clamping strip 30 is somewhat optional. The clamping strip can be made from a hard material or of the same material as the elastic loop or of a material softer than that of the elastic loop. The only requirement for the clamping strip is that the size, shape and elasticity that exists between the clamping strip and the elastic loop provide the necessary clamping power to hold and seal the closure foil 41 in place over the pan opening.

Figure 4:
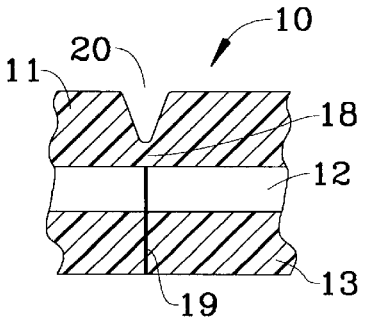
FIG. 4 is a detailed vertical sectional view taken along the lines 4—4 of FIG. 2.

FIG. 4 is a cross-section of the elastic loop 10 as shown by the section lines 4—4 in FIG. 2. It shows the details of the hinge means provided on the elastic loop. The upper loop leg 11 is pressed inwardly forming a hinge indentation 20 and living hinge 18. The lower loop leg 13 is slit 19 below the hinge so that an area adjacent the tab 26 can be bent upwardly and inwardly to provide an access to the contents of the pan for insertion or removal or ventilation. This hinge can be designed or placed to expose the contents of the pan at a corner, as shown in FIG. 1, or it can be designed to expose the contents along one side of the pan. It is preferred that the clamping strip 30 be resilient if the elastic loop has a living hinge 18 and one or two foils 40, 41 are to be used with the clamping strip on the elastic loop.

Figure 5:
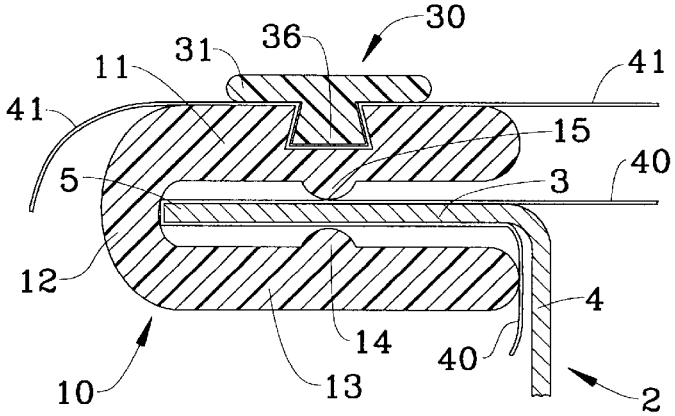
FIG. 5 is a vertical sectional view through a container having the parts shown in assembled position with two foils covering the container opening.

FIG. 5 shows a first foil 40 held in place over the pan 2 with the foil pressed against the pan flange end 5 by the elastic loop base 12 and against the pan flange 3 upper surface and pan flange lower surface by the upper bead 15 and lower bead 14 of the elastic loop legs 11, 13. At the same time a second foil 41 is held in place over the pan opening by having the foil clamped between the protrusion 36 of the clamping strip and the walls of recess 16 of the elastic loop 10. With this arrangement, a double closure seal is provided for the pan contents and the air space between the foils provides insulation.

The device is used by selecting an elastic loop that has a peripheral length that is essentially the same length as the pan flange peripheral length and placing the foil 40 over the open top of the container so that the foil extends beyond the container flanges 3 on all sides. The elastic loop 10 is then stretched and placed over the foil and over the flanges on essentially three sides. The elastic loop is then pulled so that it is over the foil and flange at the fourth side or corner and released to clamp the foil in place over the entire flange to cover the container open top. This procedure alone can be used repeatedly for providing a temporary closure for the container.

As an alternative use, the elastic loop can be placed over the container flanges without a foil and left in that position. When it is desired to cover the open top of the container, the clamping strip 30 is removed from the elastic loop 10. A foil is placed over the container open top and flanges. The clamping strip is then pressed back into place on the elastic loop, clamping the foil between the clamping strip and the elastic loop all about the extent of the elastic loop. This procedure can be used repeatedly for providing a temporary closure for the container.

As another alternative, one foil 40 can be secured under the elastic loop 10 and a second foil 41 can be clamped between the elastic loop and the clamping strip using both of the above procedures.

With all three of these foil arrangements, one corner of the container or one end of the container can be accessed temporarily by bending back the elastic loop 10 and/or the clamping strip 30 at areas where a hinge means 18, has been provided. The elastic loop and clamping strip can be removed, cleaned, and used repeatedly.

The food industry is an example of where the invention can be used. With a stainless steel pan and the appropriate plastic wraps, used with the gasket snapped around the entire perimeter of the pan, the covered pan can be placed in an oven at 300 degrees Fahrenheit or in an ALTOSHAM™ or steam table for extended periods of time without food drying out, or it can be placed in a freezer or refrigerator for extended periods of storage. The hinged flap can be bent back for ventilation and/or cooling as well as for insertion or removal of the contents of the pan.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

I claim:

1. A flexible closure holder including:

an endless elastic loop formed by a base with an upper leg and a lower leg extending from said base:

said endless elastic loop upper leg and said endless elastic loop lower leg being parallel to each other and forming an inwardly opening elongated recess that has a depth essentially the width of said elastic loop upper leg and said elastic loop lower leg with said recess having a height between said elastic loop upper leg and said elastic loop lower leg being less than the thickness of said elastic loop upper leg and less than the thickness of said elastic loop lower leg along its entire length, so as to be capable of pressing on the upper and lower surface of a horizontally outwardly extending flange of a container while its base presses against the end of said flange on said container;

said endless elastic loop being stretchable by more than 2% of its unstretched length with the ability to return to its unstretched length, so as to be able to elastically deform and hold in place a flexible closure over said container.

2. A flexible closure holder as described in claim 1 wherein:

said endless elastic loop base extends outwardly in a limited area in essentially the same plane as that of said elastic loop upper leg and said elastic loop lower leg to form a flat tab for stretching said endless elastic loop.

3. A flexible closure holder as described in claim 2 wherein:

said flat tab is provided with an indicia receiving area for indicating dates and contents.

4. A flexible closure holder as described in claim 1 wherein:

said endless elastic loop upper leg is provided with indentations forming living hinges for bending a section of said endless elastic loop.

5. A flexible closure holder as described in claim 4 wherein:

said endless elastic loop lower leg is slit under said upper leg indentations to assist bending.

6. A flexible closure holder as described in claim 1 wherein:

said endless elastic loop upper leg and said endless elastic loop lower leg are both provided with a bead that extends into said elastic loop elongated recess parallel to said endless elastic loop base to provide a line of pressure.

7. A flexible closure holder as described in claim 1 wherein:

said endless elastic loop upper leg outer surface is provided with a means for securing thereto a clamping strip.

8. A flexible closure holder as described in claim 7 wherein:

a clamping strip is secured to said endless elastic loop said means for securing said clamping strip and said endless elastic loop together have an elasticity and configuration sufficient to clamp there-between a closure foil.

9. A flexible closure holder as described in claim 8 wherein:

said endless elastic loop upper leg is provided with indentations forming living hinges for bending a section of said endless elastic loop, said endless elastic loop lower leg is slit under said upper leg indentations.

10. A flexible closure holder as described in claim 1 wherein:

said elastic loop is color coded.

11. A detachable elastic loop retaining means in combination with a container for securing a flexible foil over said container wherein:

said container has an open end with a flange extending outwardly around the periphery of said container open end;

said elastic loop has an upper leg and a lower leg extending inwardly parallel to each other from a base forming an elongated recess facing inwardly;

said recess having a height between said elastic loop upper leg and said elastic loop lower leg being less than the thickness of said elastic loop upper leg and less than the thickness of said elastic loop lower leg along its entire length, so as to be capable of pressing on the upper and lower surface of a horizontally outwardly extending flange of said container while its base presses against the end of said flange on said container;

said elastic loop is endless with said base peripheral length being essentially the same as that of said container flange outer peripheral length;

said elastic loop has enough elasticity to be stretched over said container flange and to return to its unstretched length so as to be able to secure and hold said flexible foil in place over said container open end.

12. A detachable elastic loop retaining means in combination with a container for securing a flexible foil over said container as described in claim 11 wherein:

said elastic loop upper leg outer surface is provided with a means for securing thereto a clamping strip;

a clamping strip is secured to said elastic loop;

said means for securing said clamping strip and said elastic loop together has an elasticity and configuration sufficient to clamp there-between said flexible foil;

said clamping strip has elongated upper extensions that can be used for inserting and removing said clamping strip from said means for securing said clamping strip.

13. A detachable elastic loop retaining means in combination with a container for securing a flexible foil over said container as described in claim 11 wherein:

said elastic loop includes a tab extending outwardly for stretching said elastic loop.

14. A detachable elastic loop retaining means in combination with a container for securing a flexible foil over said container as described in claim 13 wherein:

said tab is provided with a flat indicia receiving area for indicating a date and contents.

15. A detachable elastic loop retaining means in combination with a container for securing a flexible foil over said container as described in claim 11 wherein:

said elastic loop upper leg is provided with indentations forming living hinges for bending a section of said elastic loop.

16. A detachable elastic loop retaining means in combination with a container for securing a flexible foil over said container as described in claim 15 wherein:

said elastic loop lower leg is slit under said upper leg indentations to assist bending.

17. A detachable elastic loop retaining means in combination with a container for securing a flexible foil over said container as described in claim 11 wherein:

said elastic loop upper leg and said elastic loop lower leg are both provided with a bead that extends into said elastic loop elongated recess parallel to said elastic loop base.

18. A detachable elastic loop retaining means in combination with a container for securing a flexible foil over said container as described in claim 11 wherein:

said elastic loop upper leg outer surface is provided with a means for securing thereto a clamping strip.

19. A detachable elastic loop retaining means in combination with a container for securing a flexible foil over said container as described in claim 18 wherein:

a clamping strip is secured to said elastic loop;

said means for securing said clamping strip and said elastic loop together have an elasticity and configuration sufficient to clamp there-between said said flexible foil.

20. A detachable elastic loop retaining means in combination with a container for securing a flexible foil over said container as described in claim 19 wherein:

said elastic loop upper leg is provided with indentations forming living hinges for bending a section of said elastic loop, said elastic loop lower leg is slit under said upper leg indentations to assist bending.

* * * * *